US006179203B1

(12) United States Patent
Toussant et al.

(10) Patent No.: US 6,179,203 B1
(45) Date of Patent: Jan. 30, 2001

(54) SELECTIVELY REINFORCED MULTI-PLY FOOD CONTAINER

(75) Inventors: John William Toussant, West Chester; Bruce Neil Hall, Cincinnati, both of OH (US)

(73) Assignee: The Procter & Gamble Company, Cincinnati, OH (US)

( * ) Notice: Under 35 U.S.C. 154(b), the term of this patent shall be extended for 0 days.

(21) Appl. No.: 09/143,003

(22) Filed: Aug. 28, 1998

(51) Int. Cl.[7] ..... B65D 1/34; B65D 1/44

(52) U.S. Cl. ..... 229/122.34; 220/574; 220/626; 229/406; 229/407; 229/939

(58) Field of Search ..... 229/406, 407, 229/122.32, 122.34, 939, 940; 220/574, 574.3, 626, FOR 153, FOR 155

(56) References Cited

U.S. PATENT DOCUMENTS

| | | | | |
|---|---|---|---|---|
| 1,730,034 | * | 10/1929 | Faulk | 220/626 |
| 2,028,276 | * | 1/1936 | Evans | 229/122.34 |
| 3,033,434 | | 5/1962 | Carson . | |
| 3,223,309 | * | 12/1965 | Chiorri | 229/122.34 |
| 3,342,400 | * | 9/1967 | Kelley | 229/939 |
| 3,596,822 | | 8/1971 | Holley . | |
| 3,847,324 | | 11/1974 | Uchanski . | |
| 3,938,729 | * | 2/1976 | Smith | 229/939 |
| 4,026,458 | | 5/1977 | Morris et al. . | |
| 4,441,626 | | 4/1984 | Hall . | |
| 4,606,496 | | 8/1986 | Marx et al. . | |
| 4,609,140 | | 9/1986 | Van Handel et al. . | |
| 4,721,499 | | 1/1988 | Marx et al. . | |
| 4,721,500 | | 1/1988 | Van Handel et al. . | |
| 4,778,439 | | 10/1988 | Alexander . | |
| 4,848,543 | | 7/1989 | Doboze . | |
| 4,905,864 | * | 3/1990 | Balin | 229/939 |
| 5,064,055 | * | 11/1991 | Bessenbach et al. | 220/626 |
| 5,094,385 | | 3/1992 | Antczak . | |
| 5,205,476 | | 4/1993 | Sorenson . | |
| 5,230,939 | | 7/1993 | Baum . | |
| 5,279,456 | | 1/1994 | Bernstein . | |
| 5,326,020 | | 7/1994 | Cheshire et al. . | |
| 5,577,989 | | 11/1996 | Neary . | |
| 5,628,451 | | 5/1997 | Neary . | |
| 5,660,326 | * | 8/1997 | Varano et al. | 229/122.32 |
| 5,833,894 | * | 11/1998 | Lanzani et al. | 229/407 |

FOREIGN PATENT DOCUMENTS

| | | |
|---|---|---|
| 0 544 562 | 6/1993 | (EP) . |
| 2 302 533 | 1/1997 | (GB) . |
| WO 93/23294 | 11/1993 | (WO) . |
| WO 95/35204 | 12/1995 | (WO) . |

* cited by examiner

*Primary Examiner*—Gary E. Elkins
(74) *Attorney, Agent, or Firm*—Larry L. Huston; Ronald E. Hasse; Tara M. Rosnell

(57) ABSTRACT

A multi-ply food container. The multi-ply food container has selective reinforcement at the center of the food container, and regions of a raised side wall and/or rim which are not reinforced. The reinforcement is preferably done by joining an additional ply to the food container.

9 Claims, 2 Drawing Sheets

SELECTIVELY REINFORCED MULTI-PLY FOOD CONTAINER

This invention relates to food containers and more particularly to multi-ply food containers.

BACKGROUND OF THE INVENTION

Disposable food containers are well known in the art. Disposable food containers include common paper plates, bowls, clam shells, trays, etc.

The art has paid considerable attention to making, molding, and deforming these food containers out of a single plane. In this latter process a blank is provided. The blank is inserted between mating platens and pressed. The periphery of the blank may have radial grooves. The radial grooves provide for accumulation of the material deformed by the platens. Exemplary art includes U.S. Pat. No. 3,033,434, issued May 8, 1962 to Carson; U.S. Pat. No. 4,026,458, issued May 31, 1977 to Morris et al., the disclosures of which are incorporated herein by reference; U.S. Pat. No. 4,606,496, issued Aug. 19, 1986 to Marx et al.; U.S. Pat. No. 4,609,140, issued Sep. 2, 1986 to van Handel et al.; U.S. Pat. No. 4,721,500, issued Jan. 26, 1988 to van Handel et al.; U.S. Pat. No. 5,230,939, issued Jul. 27, 1993 to Baum; and U.S. Pat. No. 5,326,020, issued Jul. 5, 1994 to Cheshire et al.

The blanks are typically comprised of paperboard, and more particularly a single sheet of paperboard, as illustrated in the aforementioned patents. A single sheet of paperboard is utilized due to the belief that to deform the blank out of its plane the blank must be thin and of a single ply. The paperboard, or other material used for the blank, is typically substantially homogeneous, as illustrated by U.S. Pat. No. 4,721,499 issued Jan. 26, 1988 to Marx et al. It is believed that homogeneity aids in the radially symmetric deformation of round food containers, such as plates and bowls.

However, these attempts in the art suffer from several drawbacks. As illustrated by the plethora of attempts to improve the rigidity and stability of the food containers, the prior art attempts do not provide food containers of sufficient strength. This lack of strength leads to spillage of food when the food container becomes overloaded, or, alternatively, unduly constrains the amount of foods which can be placed on the food container at a given time.

There have been several attempts in the art to improve the rigidity of such food containers. For example, food containers having a bottom wall, a side wall disposed radially outwardly of and circumjacent the bottom wall, and a rim disposed radially outwardly of and circumjacent the side wall are known in the art. Food containers with densified regions in the side wall have been attempted in the art. Likewise, containers having densified circumferentially spaced regions extending radially through annular portions of the rim are known. Such attempts in the art are alleged to provide resistance to bending throughout the entire structure. Illustrative of such attempts are U.S. Pat. Nos. 4,606,496 issued Aug. 19, 1986 to Marx et al. and U.S. Pat. No. 4,609,140 issued Sept. 2, 1986 to Van Handel et al.

But, the side walls/rims are usually angled relative to the plane of the food container. Such angles increase the section modulus of the side wall/rim and thereby structurally increase their stiffness without densification. There is clearly a need in the art to increase the rigidity of the planar portion of the food container, as this is the portion of the food container onto which food is typically deposited.

Another attempt in the art uses multi-ply laminate food containers. One such attempt uses single face corrugated materials, as illustrated by U.S. Pat. No. 5,577,989 issued Nov. 26, 1986 to Neary. Neary acknowledges the industry has not been able to create a satisfactory unitary construction by stamping corrugated paperboard of more than two plies. But Neary's construction does not selectively reinforce the planar portion of a food container.

SUMMARY OF THE INVENTION

The invention comprises a multi-food container having an XY plane and a Z-direction orthogonal thereto. The food container comprises a first portion and a second portion. The first and second portions are spaced apart in the Z-direction. The first portion comprises more plies than the second portion.

The second portion may circumscribe the first portion and be elevated relative to the first portion when the food container is in a horizontal, in use position. The first portion may comprise the central region of the food container. The second portion may comprise the periphery of a food container.

DETAILED DESCRIPTION OF THE INVENTION

Figure 1:
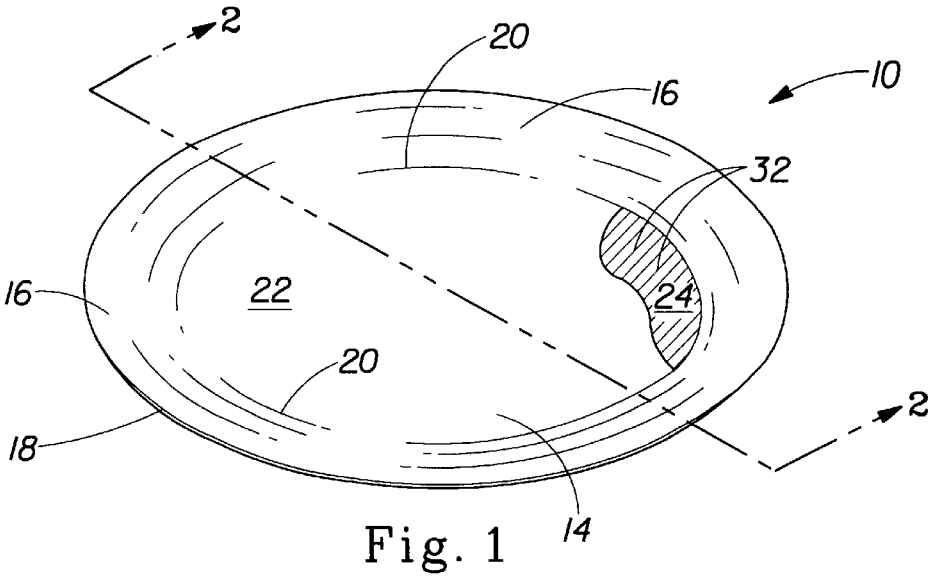
FIG. 1 is a top plan view of a food container according to the present invention shown partially in cutaway.
Figure 2:
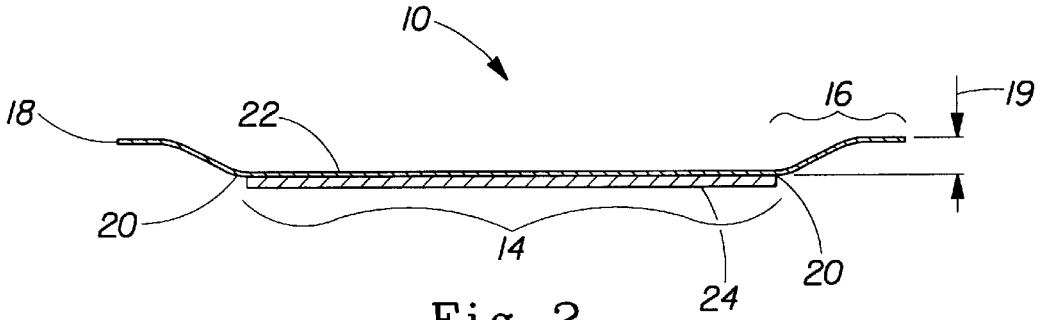
FIG. 2 is a vertical sectional view taken along the line 2—2 of FIG. 1.

Referring to FIGS. 1–2, the food container 10 according to the present invention may comprise a plate, a bowl, a tray, a clam shell, or any other configuration known in the art.

The food container 10 comprises a central region 14 and a circumjacent periphery 16. The central region 14 and periphery 16 are disposed in two different planes. The central region 14 defines the XY plane of the food container 10. The Z-direction of the food container 10 lies perpendicular to the XY plane. The food container 10 will necessarily have a transition region 20 from the central region 14 to the periphery 16. The periphery 16 is spaced apart from the central region 14 in the Z-direction. In normal use, the periphery 16 is raised relative to the central region 14. The central region 14 of the food container 10 defines a first portion of the food container 10. Likewise, the periphery 16 of the food container 10 defines a second portion of the food container 10.

The food container 10 comprises at least two plies: a first ply 22 and a second ply 24. The second ply 24 is smaller than the first ply 22, so that at least part of the food container 10 is free from the second ply 24. The second ply 24 and first ply 22 may be concentric. It is to be recognized that in alternative embodiments (not shown) the food container 10 may comprise three or more plies.

It is not necessary that either the central region 14 or the periphery 16 be parallel to the XY plane or generally planar. It is only necessary that the central region 14 and the periphery 16 be spaced apart in the Z-direction. For example, bowls having a generally concave shaped bottom will be suitable for use with the present invention. The Z-direction distance from the bottom surface of the central region 14 (taken while the food container 10 is in its normal in-use and generally horizontal position) to the top surface of the periphery 16 as the referred as to the Z-direction depth 19 of the food container 10. If there are different depths at different portions of the food container 10, the Z-direction depth is taken as that greatest Z-direction distance.

The boundary and shape of the periphery 16 are defined by the edge 18 of the food container 10. It is to be recognized that the dimensions and relative proportions of the periphery 16 and central region 14 of the food container 10 will vary according to the exact size and intended use of the food container 10. While a round food container 10 is illustrated in FIG. 1, one of ordinary skill will recognize that any suitable shape and depth of food container 10 may be selected for use with the present invention and the invention is not so limited. Other suitable shapes include squares, rectangles, ovals, various polygons, etc.

The food container 10 according to the present invention may be made of any rigid material, particularly a material which provides for the intended use of storing, cooking, dispensing and eating foods therefrom. The food container 10 may be made of cellulose, such as solid bleached sulfite paperboard and various types of wood fibers, including recycled fibers. Alternatively, suitable rigid materials for the food container 10 include foam, plastic and other synthetic materials, and aluminum foil.

One of ordinary skill will recognize that it is not necessary that the first ply 22 and second ply 24 be made of identical materials. The first ply 22 needs to be sanitary and preferably aesthetically pleasing to the consumer. However, the second ply 24 is not so limited. The second ply 24 may be chosen for strength, insulating properties and cost reduction.

If desired, one or more of the plies 22, 24 may be treated with re-enforcing material, as is well known in the art. If only one ply 22 or 24 is treated for strength, preferably it is the second ply 24. The second ply 24 may have increased strength because the second ply 24 transmits compressive and bending loads applied to the food container 10.

For example, either ply 22, 24 may be treated with epoxy or other synthetic resins as is well known in the art. Additionally or alternatively, either ply 22, 24 may be treated or impregnated with lignin as is well known in the art. It will be apparent to one of ordinary skill that various other means may be used to strengthen one or more of the plies 22, 24 as is well known in the art. For example, radial re-enforcing ribs (not shown) may be applied to the underside of the food container 10 and joined to the first ply 22. Such reinforcing ribs will distribute loads applied near the center of the food container 10 towards the edge 18 of the food container 10.

As noted above, the food container 10 is multi-planar. By multi-planar, it is meant that different portions of the food container 10 lie in different planes. An example of the multi-planarity of the food container 10 of the present invention is illustrated by the central region 14 and periphery 16 of the food container 10. The central region 14 and periphery 16 of the food container 10 are spaced apart in the Z-direction, thus rendering the food container 10 multi-planar. As noted above, typically, but not necessarily, the periphery 16 will be raised relative to the central region 14 while the food container 10 is in use.

The food container 10 according to the present invention has a convex side and a concave side. The concave side of the food container 10 is that side which typically faces the user while in use. The concave side of the food container 10 has the first ply 22 on the outwardly oriented surface. Likewise, the convex side typically faces away from the user in use and may rest upon a horizontal surface such as a table. The convex side of the food container 10 has preferably the second ply 24 on the outwardly facing surface. Alternatively, the second ply 24 may be joined to the concave side of the food container 10, and particularly to the surface of the first ply 22 which is oriented towards the user while the food container 10 is in its normal, in use position.

Thus, the first portion of the food container 10 may comprise first and second plies 22, 24. Spaced apart in the Z-direction from the first portion of the food container 10 is the second portion of the food container 10 which has only a first ply 22. It is to be recognized, however, that due to manufacturing error, selective reinforcement of asymmetrical designs, etc. the second ply 24 may partially intercept the second portion of the food container 10.

Often, differences in Z-direction elevation of the food container 10 will occur as a function of the radial position within the food container 10. However, the invention is not so limited. Differences in Z-direction elevation may occur as a function of circumferential position on the food container 10 as well. The present invention is not limited to axisymmetric food containers 10 or food containers 10 which are symmetric about any particular plane.

The multi-ply food container 10 may have at least one continuous transition region 20 between the different portions of the food container 10 which are spaced apart in the Z-direction. Alternatively, deviations or changes in Z-direction position may occur at or due to fold lines, cuts, scores or perforations. In a planar sense, the absence of fold lines, cut, scores or perforations means that there will be no vertex where the elevation of the food container 10 changes in the Z-direction. A vertex is considered to be any point in the cross-section where there is an abrupt, rather than continuous change in the Z-direction elevation. For the embodiments illustrated in the figures, changes in Z-direction elevation occur at a continuous transition region and as a function of the radial position within the food container 10.

It may be necessary to accommodate the accumulation of material which occurs when the food container 10 is formed with one or more continuous transition regions 20. Pleats or gathers are often used for this purpose. Pleats and gathers, particularly accumulation pleats having a radial orientation, are contemplated and within the scope of the present invention. Such pleats and gathers are typically transverse to the transition region 20. In contrast, cuts, scores and fold lines, are typically parallel to the transition region 20. Such pleats and gathers are transverse to the transition region 20, and do not comprise a second ply 24 which is joined to or superimposed upon the first ply 22.

The food container 10 comprises a multi-ply laminate. Preferably the laminate comprises at least two plies, a first ply 22 and a second ply 24. However, constructions of more than two plies are contemplated and within the scope of the present invention.

The first ply 22 faces the user and has food, etc. placed thereon in use. The side of the first ply 22 which, in use, faces the consumer may be a generally smooth surface. By smooth it is meant that the first ply 22 is macroscopically continuous in the XY plane and is not rough to the touch. The second ply 24 is subjacent the first ply 22. The second ply 24 may be textured to reduce slippage during use.

The first ply 22 allows for application and removal of food during eating, heating and other preparation, storage, etc. The second ply 24 allows for convenient holding of the food container 10 in one's hand, lap, on a table, etc. The first ply 22 and/or second ply 24 may be printed or coated. Printing may provide indicia. The coating may provide a sanitary or moisture impervious eating surface.

The second ply 24 is preferably discontinuously joined to the first ply 22, so that portions of the first and second plies 22, 24 are spaced apart from each other in the Z-direction. This arrangement allows air, or other insulating materials such as foam, etc. to be interposed between the first ply 22 and the second ply 24.

Preferably at least one of the first and second plies 22, 24 of the food container 10 comprises a corrugated laminate as is well known in the art. A corrugated laminate comprises a corrugated medium joined to a relatively flat liner board. The corrugated medium comprises troughs and ribs which alternately are joined to and spaced apart from the flat liner board. The ribs and troughs are often straight and parallel but may be sinusoidal. In cross section, the ribs may be S-shaped, C-shaped, Z-shaped, or have any other configuration known in the art. Corrugated laminates are described in the Fibre Box Handbook by Mead Corporation of Washington Court House, Ohio, which is incorporated herein by reference.

A particularly preferred corrugated medium comprises a wave flute. A wave flute corrugated medium has corrugations 32 with vector components parallel to both the X and Y directions. This arrangement provides the laminate with properties which are more nearly equivalent in the X and Y directions. A particularly common wave flute corrugated medium has corrugations 32 which approximate a sinusoidal pattern. Suitable corrugated media range from A to N size flutes, with E to N size flutes being preferred.

A corrugated laminate may have a basis weight of 70 to 600 grams per square meter, with a basis weight of 125 to 350 grams per square meter being preferred. While a corrugated laminate represents a preferred embodiment of the present invention, it is to be recognized that any construction of two or more plies 22, 24 joined in face-to-face relationship and which provide a food container 10 able to receive and dispense food is suitable.

The food container 10 may be formed by providing a multi-ply blank as described above. The multi-ply blank is deformed out of its plane by mating platens as is well known in the art. Exemplary apparatus suitable for deforming the blank into a three dimensional food container 10 are illustrated by U.S. Pat. No. 2,832,522 issued Apr. 29, 1958 to Schlanger; U.S. Pat. No. 2,997,927 issued Aug. 29, 1961 to Carson; U.S. Pat. No. 3,033,434 issued May 8, 1962 to Carson; U.S. Pat. No. 3,305,434 issued Feb. 21, 1967 to Bernier et al.; U.S. Pat. No. 4,026,458 issued May 31, 1977 to Morris et al, and incorporated herein by reference.

The mating platens work by deforming the multi-ply blank out of its XY plane and in the Z-direction. The platens both clamp the blank and deform it in the Z-direction. Preferably, the blank is lightly clamped at its edge 18 by a draw ring, corresponding to the periphery 16 of the food container 10. As the platens engage and deform the multi-ply blank in the Z-direction, the periphery 16 slips through the platen draw ring, due to the aforementioned light clamping force. Such slippage allows for Z-direction deflection in the blank, thereby preventing the blank from undue strain.

Importantly, in the process according to the present invention of making the food container 10 when at least the first ply 22 comprises a corrugated laminate, the mating platens deform the blank in the Z-direction, without the addition of moisture. The addition of moisture, beyond that present in the ambient, tends to produce tearing on the tension side of a corrugated laminate blank during deformation in the Z-direction. Therefore, it is preferred that the process according to the present invention be carried out in the absence of added moisture—contrary to the teachings of the prior art, as illustrated, for example, by the aforementioned U.S. Pat. No. 5,557,989 issued to Neary. But, if the first ply 22 comprises a solid bleached sulfite blank, moisture may be added during manufacture.

For a ply 22, 24 comprising a corrugated laminate the clearances between the mating platens may be adjusted such that there is only minimal compressive loading applied to the central region 14 of the food container 10. Such minimal loading is only that loading which is necessary to join the first ply 22 and second ply 24 together in face-to-face relationship. However, the periphery 16 and other portions of the food container 10 may undergo compressive loading appropriate for forming food container 10, and occasionally eccentric compressive loading for improved deformation and strength.

Figure 3:
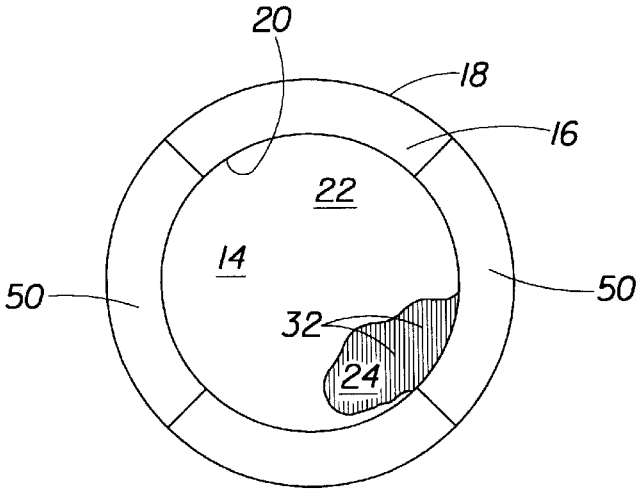
FIG. 3 is a top plan view of the shims used in the present invention superimposed on a food container, the food container being shown partially in cutaway to expose the corrugations of the second ply.

Referring to FIG. 3, if desired, the mating platens may be shimmed to prevent undue compression of the blank. The shims selectively provide compression to regions of the blank registered with the shims and prevent undue compression to other portions of the blank. If the first ply 22 has directional properties, as occurs with corrugated laminates, the shims 50 may be eccentrically arranged in an azimuthal pattern which accommodates the directional properties of the second ply 24. Unexpectedly, the major axis of the shims 50 should be parallel to the major axis of the corrugations.

This arrangement provides for more compression of the portions of the periphery 16 subtended by the shims than of the central region 14. Thus, the central region 14 will be thicker than the subtended portions of the periphery 16. Of course, since the central region 14 has more plies 22, 24 than the periphery 16, additional clearance must be provided in the mold to accommodate the added thickness of the second ply 24.

The shims 50 may have a thickness ranging from about 25 to about 75 percent, and preferably about 30 to 50 percent, of the thickness of the periphery region of the blank prior to be deformed by the mating platens. The shims 50 may taper to a lesser thickness at their ends or at the inside diameter.

The shims 50 may be disposed on opposite sectors of a round food containers 10. The sectors may each subtend an arc of 60° to 120°, and preferably about 90°, or one quadrant, of a round food container 10. If such an arrangement is selected, the shims 50 are diametrically opposed.

In a still more preferred embodiment, the platens of the mold are provided with eccentric sidewall clearances. The sidewall clearances perpendicular to the ribs of the corrugations 32 is greater than the sidewall clearances parallel to the ribs of the corrugations 32. Again, the eccentricity may continuously and gradually vary between adjacent 90° quadrants of the mold platens for a round food container 10. For the embodiments described herein, with a three ply laminate corrugated material having a basis weight of 100 to 1,000 grams per square meter, the clearances may vary from a minimum of about 0.01 to about 0.05 inches to a maximum of about 0.03 to about 0.09 inches.

In a still more preferred embodiment, the platens of the mold are provided with eccentric sidewall clearances. The sidewall clearance which is perpendicular to the ribs of the corrugations 32 is greater than the sidewall clearances parallel to the ribs of the corrugations 32. Again, the eccentricity may continuously and gradually vary between adjacent 90 degree quadrants of the platen molds for a round food container 10.

For the embodiments described herein, a food container 10 having a single corrugated laminate periphery 16 with a basis weight of about 125 to 275 grams per square meter, the platen clearances may vary from a minimum of about 0.010 to 0.020 inches to a maximum of about 0.020 to 0.040 inches in the platen periphery region. In a preferred embodiment, the food container 10 may have a two ply central region 14 comprising a double face corrugated first ply 22 and single face corrugated second ply 24 with a combined basis weight of about 275 to 675 grams per square meter with a platen clearance in the central region 14 of from about 0.050 to about 0.090 inches. Such a food container 10 may be round, having a central region 14 with a diameter of at least 4 inches and preferably at least about 6 inches and a total diameter across the edge 18 of the periphery 16 of at least about 6 inches and preferably at least about 9 inches.

If a corrugated laminate is selected for the first ply 22 or second ply 24, the corrugated laminate may be sealed at its edges 18. By "sealed" it is meant that the spaces between the ribs and troughs of the corrugations 32 of first ply 22 are enclosed at the edge 18 of the food container 10. The edge of corrugated laminate of the second ply 24 could be similarly sealed. Such sealing prevents or reduces convective currents. By preventing or reducing convective currents, thermal losses are reduced and the thermal insulting capability of the food container 10 is improved. Additionally, depending upon the materials used for sealing, the aesthetics, strength and rigidity of the food container 10 may also be improved.

Sealing the edge 18 of a corrugated laminate of the first ply 22 of the food container 10 may be accomplished by adding a separate strip of material and adhesively joining it to the edge 18, by crimping the corrugated laminate layers together at the edge 18, by dipping the edge 18 in wax, painting a thick paint onto the edge 18, or using other known filler and sealer materials applied in any suitable manner. Similar techniques could be used to seal the edge of a corrugated laminate second ply 24.

If desired, the first and second plies 22, 24 may be provided separately, rather than as a unitary laminate. The first and second plies 22, 24 may be joined together in the same process which deforms the blank into the multi-ply food container 10. This process provides the dual functionality of joining the first and second plies 22, 24 and deforming the periphery 16 of the multi-ply food container 10 in the Z-direction in a single operation.

In this process, the first and second plies 22, 24 may be provided separately. The separate first and second plies 22, 24 are then inserted into the mold. The first ply 22 is deformed by the platens, and joined to the second ply 24 at the same time.

In a particularly preferred embodiment, one platen is, of course, concave shaped and oriented so that the vector normal to and outward from the concavity has an upwards orientation (it being recognized that the vector may deviate from the vertical). In such an arrangement, the second ply 24 may be disposed into the concave shaped platen. The second ply 24 will self-center within the central region of the platen under the force of gravity, given the upwards orientation of the normal vector. The first ply 22 is then superimposed on the second ply 24, although spaced apart therefrom in the Direction. The platens then come together in the Z-direction to deform the periphery 16 of the first ply 22 and join the first and second plies 22, 24 in a single operation.

In this process, the second ply 24 may have adhesive applied to those portions of the second ply 24 which contact the first ply 22. For example, if a single face corrugated laminate is selected for the second ply 24, the crests of the ribs of the corrugations 32 may be adhesively coated. Adhesive may be applied to the crests of the ribs of the corrugations 32 by printing, as is well known in the art. Of course, it is not necessary that each corrugation 32 have adhesive applied thereto. For example, just alternate corrugations 32 or peripheral corrugations 32 could be adhesively coated, depending upon the lamination strength needed for the desired end use. Alternatively, the entire surface of second ply 24, which faces and is joined to the first ply 22 may be adhesively coated particularly if for example, a double face corrugated laminate or solid board stock is selected for the second ply 24. Suitable adhesives include pressure sensitive and starch based adhesives.

In an alternative embodiment, the entire inner surfaces of the second ply 24, or, alternatively, the crest of the ribs of the corrugations 32 of the second ply 24 may be coated with a polymeric film. The first and second plies 22, 24 are then joined together by heat sealing. In yet another alternative embodiment, it may not be necessary to provide a separate adhesive to join the first and second plies 22, 24, together. Prophetically, autogenious bonding or edge crimping may be used.

Figure 5:
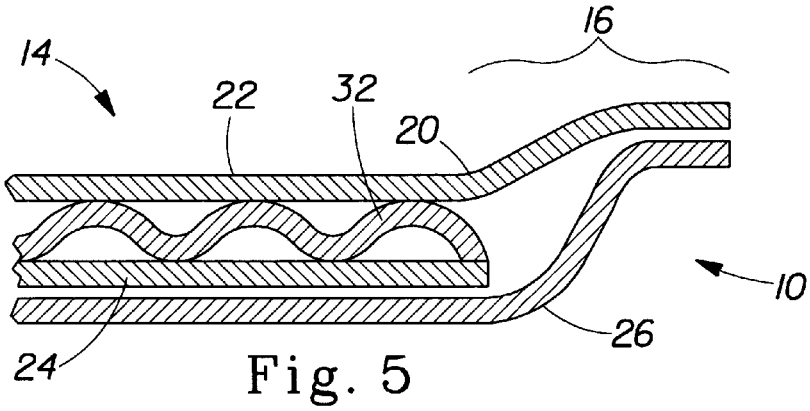
FIG. 5 is a fragmentary vertical sectional view of a food container wherein the second ply comprises a single face corrugated laminate.

If desired, laminates of more than two plies 22, 24 may be utilized. Referring to FIG. 5, for example, a three ply food container 10 having a first ply 22 and a third ply 26 coextensive of the first ply 22 may be utilized. The second ply 24 may be intermediate the first and third plies 22, 26 and retains the function of selectively reinforcing the central region 14 of the food container 10. Alternatively, a third ply 26 which is coextensive of the second ply 24 may be used. Such an arrangement provides the benefit of selectively reinforcing the central region 14 of the food container 10 without adding the same quality of additional materials to the periphery 16 of the food container 10.

It is not necessary that the third ply 26 be identical to the first ply 22 or the second ply 24. For example, corrugated laminates may have straight and/or wave flutes in the corrugations. Alternatively, intermediate plies which space apart the first and second plies 22, 24 can be a combination of corrugated materials, honeycomb, discrete spacers, foam materials etc. Various other configurations will be recognizable to one of ordinary skill in the art.

Two 9 inch diameter food containers 10 made according to the present invention and two 9 inch diameter control food containers 10 made according to the prior art were tested for weight and rigidity. Samples A were made with a 0.065 inch clearance between the platens of the mold at the central region 14 and a 0.028 inch clearance in the periphery region. Samples B were made with the same mold, adjusted to a 0.075 inch clearance between the platens of the mold at the central region and shimmed to a clearance of 0.018 inch in the periphery region. Both control food containers 10 comprised a single three layer corrugated laminate with a basis weight of about 280 grams per square meter and a thickness of about 0.035 inch. Samples A and B of food containers 10 according to the present invention were made corresponding to the platen clearances of control Sample A and control Sample B.

The food containers 10 according to the present invention utilized the same double face first ply 22 as the control samples, and additionally had a second ply 24 made of a single face corrugated laminate with a basis weight of about 385 grams per square meter and a thickness of about 0.055 inch. The corrugations 32 of the single face corrugated laminate of the second ply 24 were sprayed with 3M Super 77 MULTI-PURPOSE Spray Adhesive and placed into the upward facing concave shaped platen with the corrugations 32 facing upward. The first ply 22 was then placed between the two mold platens. The platens were closed forming a container 10 with the second ply 24 joined to the first ply 22. The second ply 24 was subjacent the first ply 22 and with the corrugated medium in contact with and joined to the first ply 22, so that the liner board of the second ply 24 was outwardly facing from the convex surface of the food container 10.

Control B' was made with a construction generally opposite that of the samples of Invention A and Invention B. Control B' utilized a double face corrugated laminate for the central region 14. Two double face corrugated laminates were joined together to provide a two ply periphery 16.

Table I shows the product weight, rigidity, the rigidity to product weight ratio, and population tested for all five samples. Rigidity was tested by deflecting four points on the rim of the food container 10 0.5 inches in the Z-direction. The four points were equally circumferentially spaced 90° apart and oriented with the machine and cross-machine directions of the corrugations 32. The peak force rating, in grams, obtained from the four deflection measurements were averaged to give a single value for that sample. Table I clearly shows the samples according to the invention demonstrate improved rigidity to weight ratios over the control samples.

TABLE I

| | Product Weight in Grams | No. of Weight Samples Tested (grams) | Grams | No. of Rigidity Samples (grams) | Rigidity to Weight Ratio (g/g) |
|---|---|---|---|---|---|
| Control A | 13.5 | N = 4 | 109.9 | N = 3 | 8.1 |
| Invention A | 23.1 | N = 9 | 227.3 | N = 6 | 9.8 |
| Control B | 13.6 | N = 3 | 129.0 | N = 3 | 9.5 |
| Invention B | 23.5 | N = 8 | 280.8 | N = 6 | 12.0 |
| Control B' | 21.2 | N = 1 | 187.7 | N = 1 | 8.9 |

Table II shows the same five samples as described in Table I. The second column of Table II shows the percent increase of rigidity to weight ratio, of the invention over the respective control. Table II compares Invention A to Control A; Invention B to Control B and Control B' to Control B. The second column of Table II also shows that Control B' showed a net decrease over the constant basis weight sample, Control B. The second column of Table II shows improvements of at least 20% over the prior art. More dramatic improvement is shown in the third column of Table II. The third column of Table II shows the difference in rigidity obtained for the difference in grams of material added to the food container 10 by the second ply 24. The third column in Table II was obtained by dividing the grams of rigidity increase , between the invention and the control, by the increase in weight necessary to make the invention. Thus, the third column of Table II shows the percent improvement, or decrease, for grams of rigidity per grams of weight addition.

The third column of Table II even more dramatically shows improvements of the invention over the controls, with greater than 50% and greater than 60% improvement on the grams of rigidity per gram of weight addition for the invention. Directionally, Control Sample B' continued to show a decrease over the uniform basis weight Control Samples.

TABLE II

| | Percent Increase (Decrease) Over Control | Percent Improvement (Decrease) for Grams Of Rigidity/Gram Weight Addition |
|---|---|---|
| Control A | — | — |
| Invention A | 21.0 | 51 |
| Control B | — | — |
| Invention B | 26.3 | 63 |
| Control B' | (−6.3) | (−18) |

Figure 6:
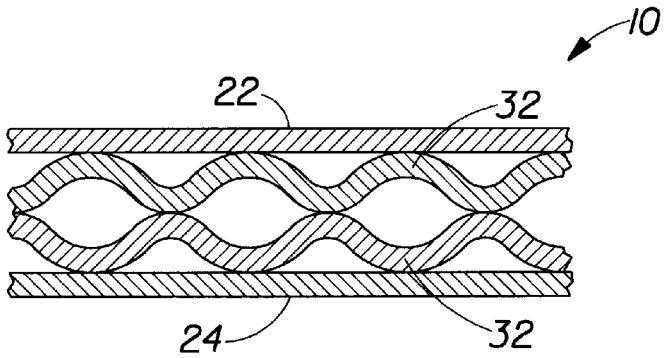
FIG. 6 is a fragmentary vertical sectional view of a food container wherein the first and second ply each comprise a corrugated laminate with parallel corrugations.
Figure 7:
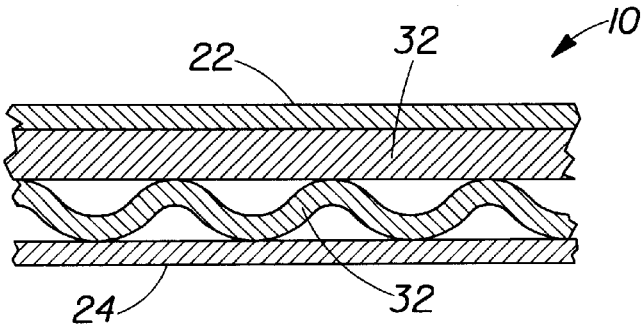
FIG. 7 is a fragmentary vertical sectional view of a food container wherein the first and second ply each comprise a corrugated laminate with perpendicular corrugations.

It will be apparent to one of ordinary skill that if corrugated laminates are selected for both the first and second plies 22, 24, several variations may be utilized. For example, an axisymmetric food container 10 such as a round food container 10 may have the corrugations 32 of the first ply 22 perpendicular to the corrugations 32 of the second ply 24 as illustrated by FIG. 7. Referring to FIG. 6, it is to be recognized that first and second plies 22, 24 having parallel corrugations may be utilized as well, although it would be expected that the arrangement of perpendicular corrugations 32 would provide a food container 10 having more axisymmetrically disposed strength.

In a nonaxisymmetric food container 10, such as a rectangular or oval shaped food container 10, it may be desirable that corrugations 32 of both the first ply 22 and the second ply 24 be parallel to the long axis of the food container 10. Conversely, the corrugations 32 of the second ply 24 may be parallel to the short axis of the food container 10, although a prophetically less preferred embodiment.

Figure 4:
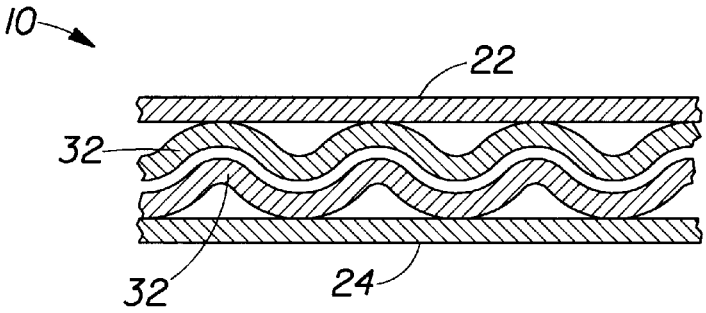
FIG. 4 is a fragmentary vertical sectional view of a food container having first and second plies, each formed of a single face corrugated material wherein the corrugated media are nested together.

The corrugated laminate of either the first ply 22 or the second ply 24 may either comprise a single or double faced corrugated laminate. However, in a preferred embodiment, the first ply 22 comprises a double faced corrugated laminate while the second ply 24 comprises a single faced corrugated laminate. Although, again, one of ordinary skill will recognize that both plies 22, 24 may comprise a single or double faced corrugated laminate and, the embodiment opposite the preferred embodiment (described above) may be utilized. Referring to FIG. 4, in yet another embodiment, the first and second plies 22, 24 may each comprise a single face corrugated laminate. The corrugations 32 of the first and second plies 22, 24 may be generally parallel, face each other and be nested together.

In yet another alternative embodiment, the food container 10 may comprise three plies. The first ply 22 comprises a single layer of solid bleach sulfite. The second ply 24 is foam. The second ply 24 is limited in size to the central region 14 of the food container 10. A third ply of solid bleach sulfite is added subjacent the second ply 24 and coextensive of the first ply 22. In such an embodiment, the foam material of the second ply 24 is sandwiched between the first ply 22 and the third ply. In such an embodiment, the second ply 24 is not visible during use—unless there are apertures through either the first ply 22 or the third ply.

Of course, the second ply 24 may have an edge 18 which is intermediate the central region 14 and the edge 18 of the first ply 22. Particularly, the edge of the second ply 24 may lie within the periphery 16 of the food container 10. Such an embodiment offers the benefit of utilizing less material than is required if both the first ply 22 and the second ply 24 were coextensive, and still strengthens the central region 14 of the food container 10. It is to be recognized that, however, it is generally preferred, although not necessary, the second ply 24 be coextensive of the central region 14.

What is claimed is:

1. A multi-ply food container having an XY plane and a Z-direction orthogonal thereto, said food container having a boundary defined by a periphery, said food container comprising a first portion and a second portion spaced from the first portion in the Z-direction, each of said first portion and said second portion comprising cellulosic plies, wherein said second portion consist of a single thickness ply, said first portion comprising more plies than said second portion, said second portion circumscribing said first portion and being elevated relative to said first portion when said food container is in a horizontal use position, such that said second portion defines said periphery of said food container.

2. A food container according to claim 1 wherein at least one of said plies of said first portion comprises a corrugated laminate.

3. A food container according to claim 2 wherein said corrugated laminate comprises a single face corrugated laminate.

4. A food container according to claim 3 wherein said first portion of said food container comprises a double face corrugated laminate.

5. A food container according to claim 1 wherein said first portion and said second portion are congruent, said second portion being annular relative to said first portion.

6. A food container according to claim 2 wherein said first ply and said second ply each comprise a corrugated laminate having corrugations, said corrugations of said second ply being parallel to said corrugations of said first ply.

7. A food container according to claim 2 wherein said first ply and said second ply each comprise a corrugated laminate having corrugations, said corrugations of said second ply being perpendicular to said corrugations of said first ply.

8. A multi-ply food container having an XY plane and a Z-direction orthogonal thereto, said food container comprising a first portion and a second portion spaced from the first portion in the Z-direction, said food container being made of two-plies, each ply comprising a single face corrugated laminate, having a corrugated medium, wherein said corrugated medium of said first ply and said corrugated medium of said second ply are juxtaposed in face to face relationship whereby said corrugated media of said first and said second plies are nested together.

9. A multi-ply food container having an XY plane and a Z-direction orthogonal thereto, said food container comprising a first portion and a second portion spaced from the first portion in the Z-direction, said food container comprising a first ply, a second ply, and a third ply, said first, second and third plies being joined in face-to-face relationship wherein said second ply comprises a single face corrugated laminate and is intermediate said first ply and said third ply, said second portion of said food container being substantially free of said second ply, said third ply and said first ply being coextensive of each other.

* * * * *